US007420113B2

(12) United States Patent
Ohno

(10) Patent No.: US 7,420,113 B2
(45) Date of Patent: Sep. 2, 2008

(54) RENDITION STYLE DETERMINATION APPARATUS AND METHOD

(75) Inventor: Kyoko Ohno, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 193 days.

(21) Appl. No.: 11/261,388

(22) Filed: Oct. 27, 2005

(65) Prior Publication Data

US 2006/0090631 A1 May 4, 2006

(30) Foreign Application Priority Data

Nov. 1, 2004 (JP) ..... 2004-317993
Nov. 5, 2004 (JP) ..... 2004-321785

(51) Int. Cl.
*A63H 5/00* (2006.01)
*G04B 13/00* (2006.01)
*G10H 7/00* (2006.01)

(52) U.S. Cl. ..... 84/609; 84/610; 84/626; 84/634; 84/649; 84/650; 84/662

(58) Field of Classification Search ..... None
See application file for complete search history.

(56) References Cited

U.S. PATENT DOCUMENTS 4,711,148 A 12/1987 Takeda et al.
5,167,179 A 12/1992 Yamauchi et al.
5,216,189 A 6/1993 Kato
5,496,963 A 3/1996 Ito
5,652,402 A 7/1997 Kondo et al.
6,486,389 B1 * 11/2002 Suzuki et al. ..... 84/603
6,911,591 B2 6/2005 Akazawa et al.
6,946,595 B2 * 9/2005 Tamura et al. ..... 84/629
2003/0154847 A1 * 8/2003 Akazawa et al. ..... 84/627
2003/0177892 A1 * 9/2003 Akazawa et al. ..... 84/616
2004/0055449 A1 * 3/2004 Akazawa et al. ..... 84/626
2005/0061141 A1 * 3/2005 Yamauchi ..... 84/600
2005/0211074 A1 * 9/2005 Sakama et al. ..... 84/626

FOREIGN PATENT DOCUMENTS

EP 1 391 873 A 2/2004

(Continued)

*Primary Examiner*—Marlon T Fletcher
(74) *Attorney, Agent, or Firm*—Morrison & Foerster LLP

(57) ABSTRACT

On the basis of performance event information, at least two notes to be sounded in succession or in an overlapping relation to each other are detected, and a tone pitch difference between the detected at least two notes is detected. Tone pitch difference limitation ranges are set in corresponding relation to various rendition styles. Rendition style to be imparted to the notes to be sounded in succession or in an overlapping relation is designated, and a comparison is made between a tone pitch difference limitation range corresponding to the designated rendition style and the detected tone pitch difference, so as determine whether the designated rendition style is applicable or not. In this way, whether the designated rendition style is to be applied or not is automatically controlled in accordance with the tone pitch difference of the at least two notes to be imparted with the rendition style. Further, pitch range limitation ranges are set in corresponding relation to various rendition styles, and the applicability of a designated rendition style is controlled depending on whether or not a tone to be imparted with the designated rendition style is within the pitch range limitation range corresponding to the designated rendition style.

17 Claims, 9 Drawing Sheets

FOREIGN PATENT DOCUMENTS

| | | | |
|---|---|---|---|
| EP | 1 453 035 | A | 9/2004 |
| EP | 1 583 074 | A | 10/2005 |
| JP | 05-002393 | | 1/1993 |
| JP | 2000-194369 | | 7/2000 |
| JP | 2003-271139 | | 9/2003 |
| JP | 2005-010438 | | 1/2005 |

* cited by examiner

| DESIGNATED RENDITION STYLE | TONE PITCH DIFFERENCE RANGE WITHIN WHICH DESIGNATED RENDITION STYLE IS MADE APPLICABLE (CENTS) | RENDITION STYLE TO BE APPLIED OUTSIDE EFFECTIVE RANGE |
|---|---|---|
| GLISS JOINT | +1000 to +1200, -1000 to -1200 | DEFAULT RENDITION STYLE |
| SHAKE JOINT | -100 to -300 | |

F I G. 4A

| DEFAULT RENDITION STYLE | TONE PITCH DIFFERENCE RANGE WITHIN WHICH DEFAULT RENDITION STYLE IS MADE APPLICABLE (CENTS) |
|---|---|
| NORMAL JOINT (LEGATO) | +100 to +800, -100 to -800 |
| JOINT HEAD (TONGUING) | +900 OR OVER, OR -900 OR LESS |

F I G. 4B

| DESIGNATED RENDITION STYLE | PITCH RANGE LIMITATIONS | RENDITION STYLE TO BE APPLIED OUTSIDE EFFECTIVE RANGE |
|---|---|---|
| BEND HEAD | WITHIN PRACTICAL PITCH RANGE, & LOWEST LIMIT IS 200 CENTS ABOVE LOWEST-PITCHED NOTE | NORMAL HEAD |
| GLISS HEAD | WITHIN PRACTICAL PITCH RANGE, & LOWEST LIMIT IS 200 CENTS ABOVE LOWEST-PITCHED NOTE | |
| FALL TAIL | WITHIN PRACTICAL PITCH RANGE, & LOWEST LIMIT IS 200 CENTS ABOVE LOWEST-PITCHED NOTE | NORMAL TAIL |
| GLISS JOINT | BOTH TONES ARE WITHIN PRACTICAL PITCH RANGE | JOINT HEAD |
| SHAKE JOINT | BOTH TONES ARE WITHIN PRACTICAL PITCH RANGE | |

F I G. 8

RENDITION STYLE DETERMINATION APPARATUS AND METHOD

BACKGROUND OF THE INVENTION

The present invention relates generally to rendition style determination apparatus, methods and programs for determining a musical expression to be imparted on the basis of characteristics of performance data. More particularly, the present invention relates to an improved rendition style determination apparatus and method which determine a rendition style to be imparted, in accordance with propriety (or appropriateness) of application (i.e., applicability) of the rendition style, to two partially overlapping notes to be sounded in succession. Further, the present invention relates to an improved rendition style determination apparatus and method which, in accordance with predetermined pitch range limitations, determine applicability of a rendition style designated as an object to be imparted and then determine a rendition style to be imparted in accordance with the thus-determined applicability.

In recent years, electronic musical instruments have been popularly used which electronically generate tones on the basis of performance data generated in response to operation, by a human player, of a performance operator unit or performance data prepared in advance. The performance data for use in such electronic musical instruments are constructed as, for example, MIDI data corresponding to notes and musical signs on a musical score. However, if respective tone pitches of a series of notes are represented by only tone pitch information, such as note-on information and note-off information, then an automatic performance of tones executed, for example, by reproducing such performance data tends to become mechanical and expressionless and hence musically unnatural. Thus, there have heretofore been known apparatus which are designed to make a performance-data-based performance more musically natural, beautiful and vivid, such as: apparatus that can execute a performance while imparting the performance with rendition styles designated in accordance with user's operation; and apparatus that determines various musical expressions, representing rendition styles etc., on the basis of characteristics of performance data so that it can execute a performance while automatically imparting the performance with rendition styles corresponding to the determination results. Among such known apparatus is the apparatus disclosed in Japanese Patent Application Laid-open Publication No. 2003-271139 (corresponding to U.S. Pat. No. 6,911,591). In the conventionally-known apparatus, determinations are made, on the basis of characteristics of performance data, about various musical expressions and rendition styles (or articulation) characterized by a musical instrument and the rendition styles are imparted to the performance data. For example, each position, suitable for execution of a staccato, legato or other rendition style, is automatically searched or found from among the performance data, and then performance information (e.g., rendition style designating event), capable of achieving a rendition, such as a staccato or legato (also called "slur"), is newly imparted to the thus-found position of the performance data.

In order to allow an electronic musical instrument to reproduce more realistically a performance of a natural musical instrument, such as an acoustic musical instrument, it is essential to appropriately use a variety of rendition styles; any rendition styles are, in theory, realizable by a tone generator provided in the electronic musical instrument. However, if a performance on an actual natural musical instrument is considered, it is, in practice, sometime difficult for the actual natural musical instrument to execute the performance and impart some designated rendition styles due to various limitations, such as those in the construction of the musical instrument, characteristics of the rendition styles and fingering during the performance. For example, despite the fact that it is very difficult for an actual natural musical instrument to impart a glissando rendition style to two partially overlapping notes to be sounded in succession because a tone pitch difference (i.e., interval) between the two notes is extremely small, it has been conventional for the known apparatus to apply as-is a glissando rendition style having been determined (or designated in advance) as a rendition style to be imparted to such two partially overlapping notes. Namely, in the past, even where a rendition style designated as an object to be imparted is an unsuitable one that is difficult to execute even on a natural musical instrument, the designated rendition style would be undesirably applied as-is, which thus results in a performance with a musically unnatural expression.

Further, in not only actual natural musical instruments but also electronic musical instruments of different model types and/or makers etc., there are some limitations in the pitch range specific to the musical instrument or in a user-set available pitch range (in this specification, these pitch ranges are referred to as "practical pitch ranges"). Thus, when a performance is to be executed on an electronic musical instrument using a desired tone color of a natural musical instrument, impartment of some rendition style, designated as an object to be imparted, is sometimes inappropriate. Regarding impartment of a bend-up rendition style, for example, it is not possible to use an actual natural musical instrument to execute a performance while effecting a bend-up from outside the practical pitch range into the practical pitch range. However, the conventional electronic musical instruments are constructed to apply as-is a bend-up rendition style, determined (or designated in advance) as an object to be imparted, and thus, even a bend-up from outside the practical pitch range into the practical pitch range, which has heretofore been non-executable by actual natural musical instruments, would be carried out in the electronic musical instrument in undesirable form; namely, in such a case, the performance by the electronic musical instrument tends to break off abruptly at a time point when the tone pitch has shifted from outside the practical pitch range into the practical pitch range in accordance with the bend-up instruction. Namely, even where a rendition style to be imparted is of a type that uses a pitch outside the practical pitch range and hence is non-realizable with a natural musical instrument, the conventional technique applies such a designated rendition style as-is, which would result in a musically unnatural performance.

SUMMARY OF THE INVENTION

In view of the foregoing, it is an object of the present invention to provide a rendition style determination apparatus, method and program which permit a more realistic performance close to a performance of a natural musical instrument by avoiding application of a rendition style that is, in practice, difficult to perform.

It is another object of the present invention to a provide rendition style determination apparatus, method and program which permit a more realistic performance close to a performance of a natural musical instrument by avoiding application of a rendition style that is difficult to achieve using a practical pitch range alone.

According to an aspect of the present invention, there is provided an improved rendition style determination apparatus, which comprises: a supply section that supplies performance event information; a setting section that sets a tone pitch difference limitation range in correspondence with a given rendition style; a detection section that, on the basis of the supplied performance event information, detects at least two notes to be sounded in succession or in an overlapping relation to each other and detects a tone pitch difference between the detected at least two notes; an acquisition section that acquires information designating a rendition style to be imparted to the detected at least two notes; and a rendition style determination section that, on the basis of a comparison between the set tone pitch difference limitation range corresponding to the rendition style designated by the acquired information and a tone pitch difference between the at least two notes detected by the detection section, determines applicability of the rendition style designated by the acquired information. When the rendition style determination section has determined that the designated rendition style is appropriately applicable, the rendition style determination section determines the designated rendition as a rendition style to be imparted to the detected at least two notes.

Namely, when a rendition style has been designated which is to be imparted to at least two notes to be sounded in succession or in an overlapping relation to each other, an applicability determination is made, on the basis of a comparison between the tone pitch difference limitations corresponding to the designated rendition style and the tone pitch difference between the at least two notes detected by the detection section, as to whether the designated rendition style is to be applied or not, and a rendition style to be imparted is determined in accordance with the result of the applicability determination. Thus, the present invention can avoid a rendition style from being undesirably applied in relation to a tone pitch difference that is, in practice, impossible because of the specific construction of the musical instrument or characteristics of the rendition style, and thus, it can avoid an unnatural performance. As a result, the present invention permits a more realistic performance close to a performance of a natural musical instrument.

According to another aspect of the present invention, there is provided an improved rendition style determination apparatus, which comprises: a supply section that supplies performance event information; a setting section that sets a pitch range limitation range in correspondence with a given rendition style; an acquisition section that acquires information designating a rendition style to be imparted to a tone; a detection section that, on the basis of the performance event information supplied by the supply section, detects a tone to be imparted with the rendition style designated by the information acquired by the acquisition section and a pitch of the tone; and a rendition style determination section that, on the basis of a comparison between the set pitch range limitation range corresponding to the designated rendition style by the acquired information and the pitch of the tone detected by the detection section, determines applicability of the designated rendition style. When the rendition style determination section has determined that the designated rendition style is appropriately applicable, the rendition style determination section determines the designated rendition as a rendition style to be imparted to the detected tone. Because it is automatically determined, in accordance with a pitch range of a tone to be imparted with a designated rendition style, whether or not the designated rendition style is to be applied, the present invention can avoid a rendition style from being applied in relation to a tone of a pitch outside a predetermined pitch range, and thus, it can avoid application of a rendition style that is, in practice, difficult to perform and avoid a performance with a musically unnatural expression. As a result, the present invention permits a more realistic performance close to a performance of a natural musical instrument.

The present invention may be constructed and implemented not only as the apparatus invention as discussed above but also as a method invention. Also, the present invention may be arranged and implemented as a software program for execution by a processor such as a computer or DSP, as well as a storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which:

FIG. 4 is a conceptual diagram showing examples of tone pitch difference limitation conditions in the first embodiment:

FIG. 8 is a conceptual diagram showing some examples of pitch range limitation conditions;

DETAILED DESCRIPTION OF THE INVENTION

Figure 1:
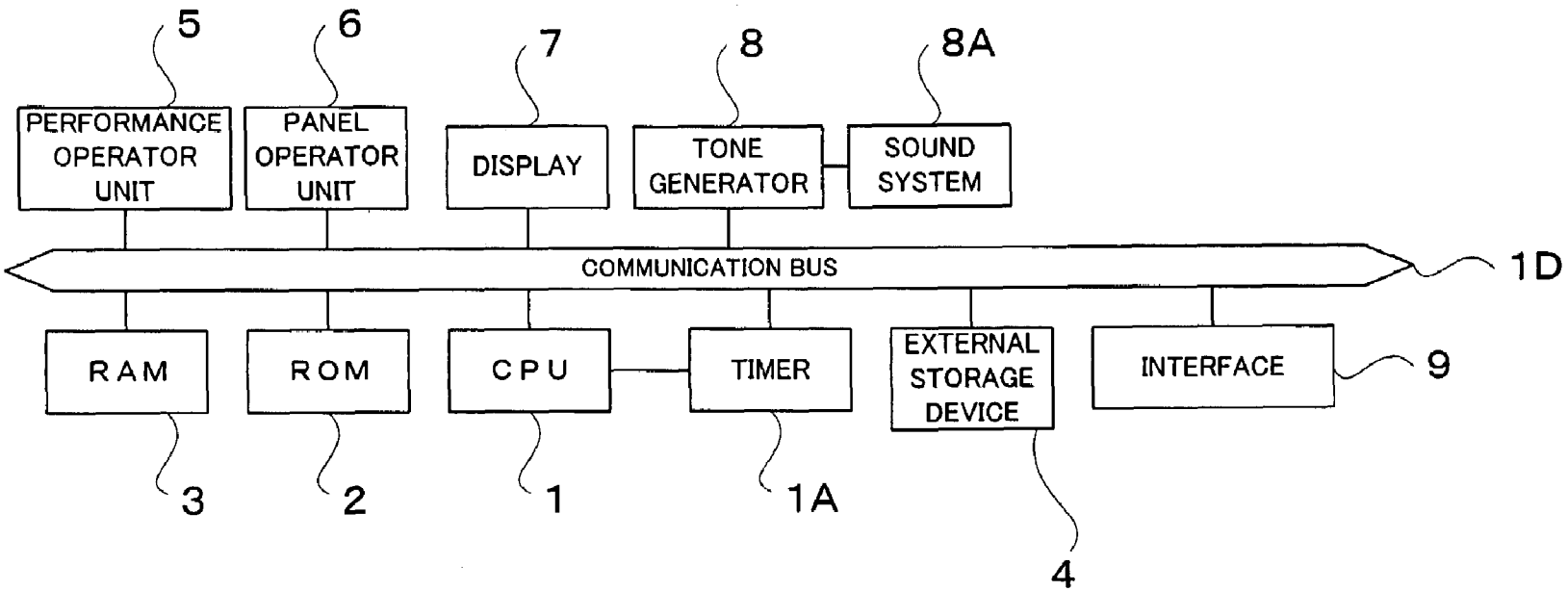
FIG. 1 is a block diagram showing an example of a general hardware setup of an electronic musical instrument employing a rendition style determination apparatus in accordance with an embodiment of the present invention.

FIG. 1 is a block diagram showing an example of a general hardware setup of an electronic musical instrument employing a rendition style determination apparatus in accordance with a first embodiment of the present invention. The electronic musical instrument illustrated here is equipped with performance functions, such as a manual performance function for electronically generating tones on the basis of performance data supplied in real time in response to operation, by a human operator, on a performance operator unit 5 and an automatic performance function for successively generating tones on the basis of performance data prepared in advance and supplied in real time in accordance with a performance progression order. The electronic musical instrument is also equipped with a function for executing a performance while imparting thereto rendition styles designated in accordance with rendition style designating operation, by the human player, via rendition style designation switches during execution of any one of the above-mentioned performance functions, as well as an automatic rendition style determination function for determining a rendition style as a musical expression to be newly imparted on the basis of characteristics of the supplied performance data and then designating a rendition style to be imparted in accordance with the result of the automatic rendition style determination. The electronic musical instrument is further equipped with an ultimate rendition style determination function for ultimately determining a rendition style to be imparted in accordance with rendition style designating operation, by the human player, via the rendition style designation switches or in accordance with propriety of application (i.e., "applicability") of the rendition style designated through the above-mentioned automatic rendition style determination function.

The electronic musical instrument shown in FIG. 1 is implemented using a computer, where various processing, such as "performance processing" (not shown) for realizing the above-mentioned performance functions, "automatic rendition style determination processing" (not shown) for realizing the above-mentioned automatic rendition style determination function and "rendition style determination processing" (FIG. 5 to be explained later), are carried out by the computer executing respective predetermined programs (software). Of course, the above-mentioned various processing may be implemented by microprograms being executed by a DSP (Digital Signal Processor), rather than by such computer software. Alternatively, these processing may be implemented by a dedicated hardware apparatus having discrete circuits or integrated or large-scale integrated circuit incorporated therein, rather than the programs.

In the electronic musical instrument of FIG. 1, various operations are carried out under control of a microcomputer including a microprocessor unit (CPU) 1, a read-only memory (ROM) 2 and a random access memory (RAM) 3. The CPU 1 controls behavior of the entire electronic musical instrument. To the CPU 1 are connected, via a communication bus (e.g., data and address bus) 1D, the ROM 2, RAM 3, external storage device 4, performance operator unit 5, panel operator unit 6, display device 7, tone generator 8 and interface 9. Also connected to the CPU 1 is a timer 1A for counting various times, for example, to signal interrupt timing for timer interrupt processes. Namely, the timer 1A generates tempo clock pulses for counting a time interval or setting a performance tempo with which to automatically perform a music piece in accordance with predetermined music piece data. The frequency of the tempo clock pulses is adjustable, for example, via a tempo-setting switch of the panel operator unit 6. Such tempo clock pulses generated by the timer 1A are given to the CPU 1 as processing timing instructions or as interrupt instructions. The CPU 1 carries out various processing in accordance with such instructions. The above-mentioned various processing are carried out by the CPU 1 in accordance with such instructions. Although the embodiment of the electronic musical instrument may include other hardware than the above-mentioned, it will be described in relation to a case where only minimum necessary resources are employed.

The ROM 2 stores therein various programs to be executed by the CPU 1 and also stores therein, as a waveform memory, various data, such as waveform data (e.g., rendition style modules to be later described in relation to FIG. 2B) corresponding to rendition styles unique to or peculiar to various musical instruments. The RAM 3 is used as a working memory for temporarily storing various data generated as the CPU 1 executes predetermined programs, and as a memory for storing a currently-executed program and data related to the currently-executed program. Predetermined address regions of the RAM 3 are allocated to various functions and used as various registers, flags, tables, memories, etc. The external storage device 4 is provided for storing various data, such as performance data to be used for an automatic performance and waveform data corresponding to rendition styles, and various control programs, such as the "rendition style determination processing" (see FIG. 5). Where a particular control program is not prestored in the ROM 2, the control program may be prestored in the external storage device (e.g., hard disk device) 4, so that, by reading the control program from the external storage device 4 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 4 may use any of various removable-type external recording media other than the hard disk (HD), such as a flexible disk (FD), compact disk (CD-ROM or CD-RAM), magneto-optical disk (MO) and digital versatile disk (DVD). Alternatively, the external storage device 4 may be a semiconductor memory or the like.

The performance operator unit 5 is, for example, in the form of a keyboard including a plurality of keys operable to select pitches of tones to be generated and key switches corresponding to the keys. This performance operator unit 5 can be used not only for a real-time manual performance based on manual playing operation by the human player, but also as an input means for selecting a desired one of prestored sets of performance data to be automatically performed. It should be obvious that the performance operator unit 5 may be other than the keyboard type, such as a neck-like type having tone-pitch-selecting strings provided thereon. The panel operator unit 6 includes various operators, such as performance data selection switches for selecting a desired one of the sets of performance data to be automatically performed and determination condition input switches for entering a desired rendition style determination criterion or condition to be used to automatically determine a rendition style, rendition style designation switches for directly designating a desired rendition style to be imparted, and tone pitch difference limitation input switches for entering tone pitch difference limitations (see FIG. 4 to be later explained) to be used to determine applicability of a rendition style. Of course, the panel operator unit 6 may include other operators, such as a numeric keypad for inputting numerical value data to be used for selecting, setting and controlling tone pitches, colors, effects, etc. to be used in a performance, keyboard for inputting text or character data and a mouse for operating a pointer to designate a desired position on any one of various screens displayed on the display device 7. For example, the display device 7 comprises a liquid crystal display (LCD), CRT (Cathode Ray Tube) and/or the like, which visually displays various screens in response to operation of the corresponding switches or operators, various information, such as performance data and waveform data, and controlling states of the CPU 1.

The tone generator 8, which is capable of simultaneously generating tone signals in a plurality of tone generation channels, receives performance data supplied via the communication bus 1D and synthesizes tones and generates tone signals on the basis of the received performance data. Namely, as waveform data corresponding to rendition style designating information (rendition style designating event), included in performance data, are read out from the ROM 2 or external storage device 4, the read-out waveform data are delivered via the bus 1D to the tone generator 8 and buffered as necessary. Then, the tone generator 8 outputs the buffered waveform data at a predetermined output sampling frequency. Tone signals generated by the tone generator 8 are subjected to predetermined digital processing performed by a not-shown effect circuit (e.g., DSP (Digital Signal Processor)), and the tone signals having undergone such digital processing are then supplied to a sound system 8A for audible reproduction or sounding.

The interface 9, which is, for example, a MIDI interface or communication interface, is provided for communicating various information between the electronic musical instrument and external performance data generating equipment (not shown). The MIDI interface functions to input performance data of the MIDI standard from the external performance data generating equipment (in this case, other MIDI equipment or the like) to the electronic musical instrument or output performance data of the MIDI standard from the electronic musical instrument to other MIDI equipment etc. The other MIDI equipment may be of any desired type (or operating type), such as the keyboard type, guitar type, wind instrument type, percussion instrument type or gesture type, as long as it can generate data of the MIDI format in response to operation by a user of the equipment. The communication interface is connected to a wired or wireless communication network (not shown), such as a LAN, Internet or telephone line network, via which the communication interface is connected to the external performance data generating equipment (in this case, server computer or the like). Thus, the communication interface functions to input various information, such as a control program and performance data, from the server computer to the electronic musical instrument. Namely, the communication interface is used to download particular information, such as a particular control program or performance data, from a server computer in a case where the particular information is not stored in the ROM 2, external storage device 4 or the like. In such a case, the electronic musical instrument, which is a "client", sends a command to request the server computer to download the particular information, such as a particular control program or performance data, by way of the communication interface and communication network. In response to the command from the client, the server computer delivers the requested information to the electronic musical instrument via the communication network. The electronic musical instrument receives the particular information via the communication interface and accumulatively stores it into the external storage device 4. In this way, the necessary downloading of the particular information is completed.

Note that, where the interface 9 is the MIDI interface, it may be a general-purpose interface rather than a dedicated MIDI interface, such as RS232-C, USB (Universal Serial Bus) or IEEE1394, in which case other data than MIDI event data may be communicated at the same time. In the case where such a general-purpose interface as noted above is used as the MIDI interface, the other MIDI equipment connected with the electronic musical instrument may be designed to communicate other data than MIDI event data. Of course, the music information handled in the present invention may be of any other data format than the MIDI format, in which case the MIDI interface and other MIDI equipment are constructed in conformity to the data format used.

Figure 2A:
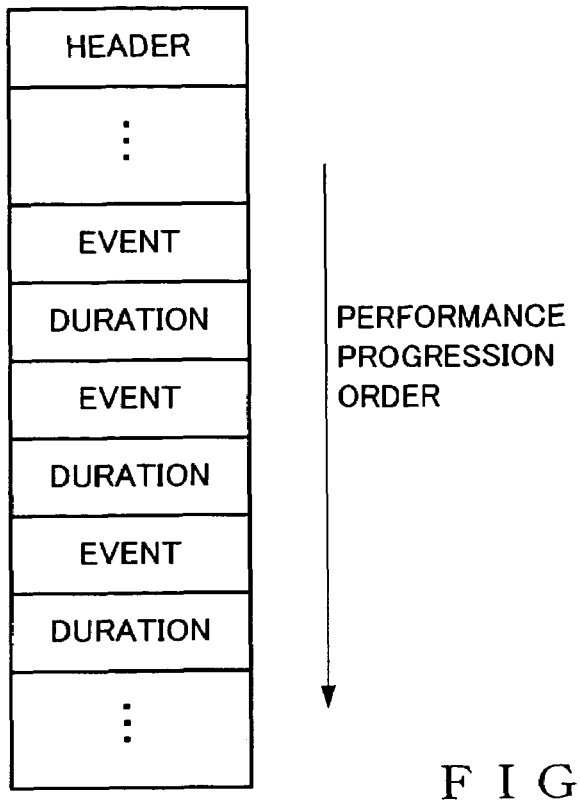
FIG. 2A is a conceptual diagram explanatory of an example of a performance data set.

Now, a description will be made about the performance data and waveform data stored in the ROM 2, external storage device 4 or the like, with reference to FIGS. 2A and 2B. FIG. 2A is a conceptual diagram explanatory of an example set of performance data.

As shown in FIG. 2A, each performance data set comprises data that are, for example, representative of all tones in a music piece and are stored as a file of the MIDI format, such as an SMF (Standard MIDI File). The performance data set comprises combinations of timing data and event data. Each event data is data pertaining to a performance event, such as a note-on event instructing generation of a tone, note-off event instructing deadening or silencing of a tone, or rendition style designating event. Each of the event data is used in combination with timing data. In the instant embodiment, each of the timing data is indicative of a time interval between two successive event data (i.e., duration data); however, the timing data may be of any desired format, such as a format using data indicative of a relative time from a particular time point or an absolute time. Note that, according to the conventional SMF, times are expressed not by seconds or other similar time units, but by ticks that are units obtained by dividing a quarter note into 480 equal parts. Namely, the performance data handled in the instant embodiment may be in any desired format, such as: the "event plus absolute time" format where the time of occurrence of each performance event is represented by an absolute time within the music piece or a measure thereof, the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event. Furthermore, the performance data set may of course be arranged in such a manner that event data are stored separately on a track-by-track basis, rather than being stored in a single row with data of a plurality of tracks stored mixedly, irrespective of their assigned tracks, in the order the event data are to be output. Note that the performance data set may include other data than the event data and timing data, such as tone generator control data (e.g., data for controlling tone volume and the like).

This and following paragraphs describe the waveform data handled in the instant embodiment. FIG. 2B is a schematic view explanatory of examples of waveform data. Note that FIG. 2B shows examples of waveform data suitable for use in a tone generator that uses a tone waveform control technique known as "AEM (Articulation Element Modeling)" technique (such a tone generator is called "AEM tone generator"); the AEM technique is intended to perform realistic reproduction and reproduction control of various rendition styles peculiar to various natural musical instruments or rendition styles faithfully expressing articulation-based tone color variations. For such purposes, the AEM technique prestores entire waveforms corresponding to various rendition styles (hereinafter referred to as "rendition style modules") in partial sections, such as an attack portion, release (or tail) portion, body portion, etc. of each individual tone, and forms a continuous tone by time-serially combining some of the prestored rendition style modules.

In the ROM 2, external storage device 4 and/or the like, there are stored, as "rendition style modules", a multiplicity of original rendition style waveform data sets and related data groups for reproducing waveforms corresponding to various rendition styles peculiar to various musical instruments. Note that each of the rendition style modules is a rendition style waveform unit that can be processed as a single data block in a rendition style waveform synthesis system; in other words, each of the rendition style modules is a rendition style waveform unit that can be processed as a single event. Each rendition style module comprises combinations of rendition style waveform data and rendition style parameters. As seen from FIG. 2B, the rendition style waveform data sets of the various rendition style modules include in terms of characteristics of types of rendition styles of performance tones: those defined in correspondence with partial sections of a performance tone, such as head, body and tail portions (head-related, body-related and tail-related rendition style modules); and those defined in correspondence with joint sections between successive tones such as a slur (joint-related rendition style modules).

Such rendition style modules can be classified into several major types on the basis of characteristics of the rendition styles, timewise segments or sections of performances, etc. For example, the following are seven major types of rendition style modules thus classified in the instant embodiment:

1) "Normal Head" (abbreviated NH): This is a head-related (or head-type) rendition style module representative of (and hence applicable to) a rise portion (i.e., "attack" portion) of a tone from a silent state;
2) "Joint Head" (abbreviated JH): This is a head-related rendition style module representative of (and hence applicable to) a rise portion of a tone realizing a tonguing rendition style that is a special kind of rendition style different from a normal attack.
3) "Normal Body" (abbreviated NB): This is a body-related (or body-type) rendition style module representative of (and hence applicable to) a body portion of a tone in between rise and fall portions of the tone;
4) "Normal Tail" (abbreviated NT): This is a tail-related (or tail-type) rendition style module representative of (and hence applicable to) a fall portion (i.e., "release" portion) of a tone to a silent state;
5) "Normal Joint" (abbreviated NJ): This is a joint-related (or joint-type) rendition style module representative of (and hence applicable to) a joint portion interconnecting two successive tones by a legato (slur) with no intervening silent state;
6) "Gliss Joint" (abbreviated GJ): This is a joint-related rendition style module representative of (and hence applicable to) a joint portion which interconnects two tones by a glissando with no intervening silent state; and
7) "Shake Joint" (abbreviated SJ): This is a joint-related rendition style module representative of (and hence applicable to) a joint portion which interconnects two tones by a shape with no intervening silent state.

It should be appreciated here that the classification into the above seven rendition style module types is just illustrative, and the classification of the rendition style modules may of course be made in any other suitable manner; for example, the rendition style modules may be classified into more than seven types. Further, needless to say, the rendition style modules may also be classified per original tone source, such as the human player, type of musical instrument or performance genre.

Further, in the instant embodiment, each set of rendition style waveform data, corresponding to one rendition style module, is stored in a database as a data set of a plurality of waveform-constituting factors or elements, rather than being stored merely as originally input; each of the waveform-constituting elements will hereinafter be called a vector. As an example, each rendition style module includes the following vectors. Note that "harmonic" and "nonharmonic" components are defined here by separating an original rendition style waveform in question into a waveform segment having a pitch-harmonic component (harmonic component) and the remaining waveform segment having a non-pitch-harmonic component (nonharmonic component).

1) Waveform shape (timbre) vector of the harmonic component: This vector represents only a characteristic of a waveform shape extracted from among the various waveform-constituting elements of the harmonic component and normalized in pitch and amplitude.
2) Amplitude vector of the harmonic component: This vector represents a characteristic of an amplitude envelope extracted from among the waveform-constituting elements of the harmonic component.
3) Pitch vector of the harmonic component: This vector represents a characteristic of a pitch extracted from among the waveform-constituting elements of the harmonic component; for example, it represents a characteristic of timewise pitch fluctuation relative to a given reference pitch.
4) Waveform shape (timbre) vector of the nonharmonic component: This vector represents only a characteristic of a waveform shape (noise-like waveform shape) extracted from among the waveform-constituting elements of the nonharmonic component and normalized in amplitude.
5) Amplitude vector of the nonharmonic component: This vector represents a characteristic of an amplitude envelope extracted from among the waveform-constituting elements of the nonharmonic component.

The rendition style waveform data of the rendition style module may include one or more other types of vectors, such as a time vector indicative of a time-axial progression of the waveform, although not specifically described here.

For synthesis of a rendition style waveform, waveforms or envelopes corresponding to various constituent elements of the rendition style waveform are constructed along a reproduction time axis of a performance tone by applying appropriate processing to these vector data in accordance with control data and arranging or allotting the thus-processed vector data on or to the time axis and then carrying out a predetermined waveform synthesis process on the basis of the vector data allotted to the time axis. For example, in order to produce a desired performance tone waveform, i.e. a desired rendition style waveform exhibiting predetermined ultimate rendition style characteristics, a waveform segment of the harmonic component is produced by imparting a harmonic component's waveform shape vector with a pitch and time variation characteristic thereof corresponding to a harmonic component's pitch vector and an amplitude and time variation characteristic thereof corresponding to a harmonic component's amplitude vector, and a waveform segment of the nonharmonic component is produced by imparting a nonharmonic component's waveform shape vector with an amplitude and time variation characteristic thereof corresponding to a nonharmonic component's amplitude vector. Then, the desired performance tone waveform can be produced by additively synthesizing the thus-produced harmonic and nonharmonic components' waveform segments.

Figure 2B:
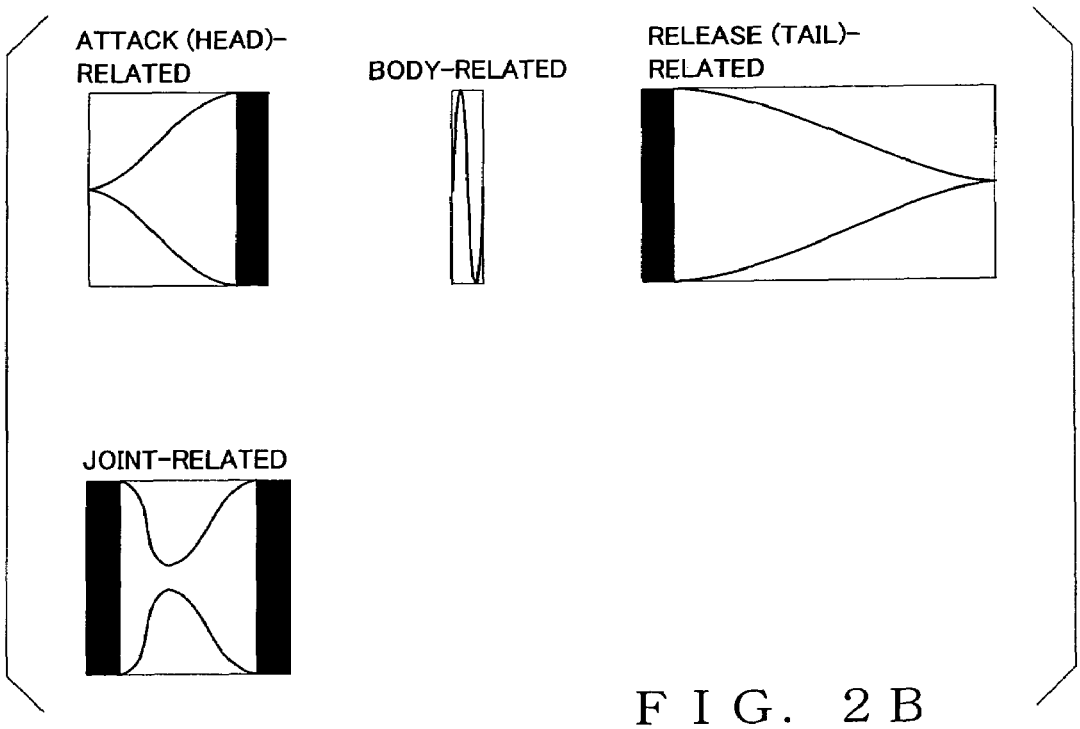
FIG. 2B is a conceptual diagram explanatory of examples of waveform data sets.

Each of the rendition style modules comprises data including rendition style waveform data as illustrated in FIG. 2B and rendition style parameters. The rendition style parameters are parameters for controlling the time, level etc. of the waveform represented by the rendition style module. The rendition style parameters may include one or more kinds of parameters that depend on the nature of the rendition style module in question. For example, the "normal head" or "joint head" rendition style module may include different kinds of rendition style parameters, such as an absolute tone pitch and tone volume immediately after the beginning of generation of a tone, the "Normal Body" rendition style module may include different kinds of rendition style parameters, such as an absolute tone pitch of the module, start and end times of the normal body and dynamics at the beginning and end of the normal body. These "rendition style parameters" may be prestored in the ROM 2 or the like, or may be entered by user's input operation. The existing rendition style parameters may be modified as necessary via user operation. Further, in a situation where no rendition style parameter has been given at the time of reproduction of a rendition style waveform, predetermined standard rendition style parameters may be automatically imparted. Furthermore, suitable parameters may be automatically produced and imparted in the course of processing.

The electronic musical instrument shown in FIG. 1 has the performance function for generating tones on the basis of performance data supplied in response to operation, by the human player, on the performance operator unit 5 or on the basis of performance data prepared in advance. During execution of such a performance function, the electronic musical instrument can perform the automatic rendition style determination function for determining a rendition style as a musical expression to be newly imparted on the basis of characteristics of the supplied performance data and then designate a rendition style to be imparted in accordance with the determination result. Then, the electronic musical instrument can ultimately determine a rendition style to be imparted in accordance with rendition style designating operation, by the human player, via the rendition style designation switches or in accordance with the "applicability" of the rendition style designated through the above-mentioned, automatic rendition style determination function. Such an automatic rendition style determination function and ultimate rendition style determination function will be described with reference to FIG. 3.

Figure 3:
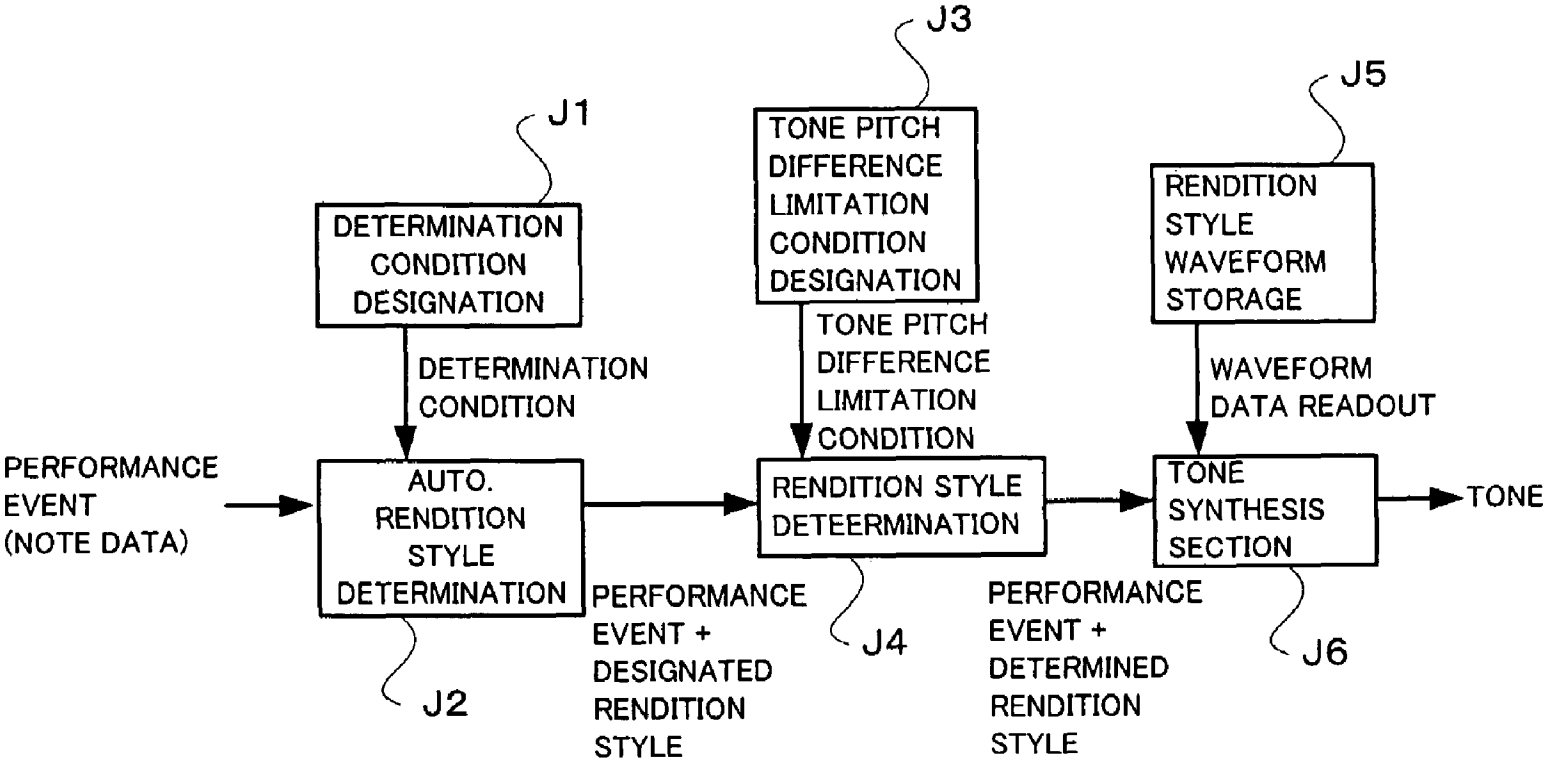
FIG. 3 is a functional block diagram explanatory of an automatic rendition style determination function and ultimate rendition style determination function in a first embodiment of the present invention.

FIG. 3 is a functional block diagram explanatory of the automatic rendition style determination function and ultimate rendition style determination function in relation to a first embodiment of the present invention, where arrows indicate flows of data.

In FIG. 3, a determination condition designation section J1 shows a "determination condition entry screen" (not shown) on the display device 7 in response to operation of determination condition entry switches and accepts user's entry of a determination condition to be used for designating a rendition style to be imparted. Once startup of the performance function is instructed, performance event information is sequentially supplied in real time in response to human player's operation on the operator unit 5, or sequentially supplied from designated performance data in accordance with a predetermined performance progression order. The supplied performance data include at least performance event information, such as information of note-on and note-off events. Automatic rendition style determination section J2 carries out conventionally-known "automatic rendition style determination processing" (not shown) to automatically determine a rendition style to be imparted to the supplied performance event information. Namely, the automatic rendition style determination section J2 determines, in accordance with the determination condition given from the determination condition designation section J1, whether or not a predetermined rendition style is to be newly imparted to a predetermined note for which no rendition style is designated in the performance event information. In the first embodiment, The automatic rendition style determination section J2 determines whether or not a rendition style is to be imparted to two partially overlapping notes to be sounded in succession, i.e. one after another (more specifically, to a pair of notes where, before a note-off signal of a first tone, a note-on signal of the second tone has been input). Then, when the automatic rendition style determination section J2 has determined that a rendition style is to be newly imparted, it sends the performance event information to a rendition style determination section J4 after having imparted a rendition style designating event ("designated rendition style" in the figure), representing the rendition style to be imparted, to the performance event information. The "automatic rendition style impartment determination processing" is conventionally known per se and will not be described in detail.

Tone pitch difference (interval) limitation condition designation section J3 displays on the display 7 a "tone pitch difference condition input screen" (not shown) etc. in response to operation of the tone pitch limitation condition input switches, and accepts entry of a tone pitch difference that is a musical condition or criterion to be used in determining the applicability of a designated rendition style. The designated rendition style for which the applicability is determined, is either a rendition style designated in response to operation, by the human player, of rendition style designation switches, or a rendition style designated in response to execution of the "automatic rendition style determination processing" by the automatic rendition style determination section J2. The ultimate rendition style determination section J4 performs the "rendition style determination processing" (see FIG. 5 to be later explained) ultimately determines a rendition style to be imparted, on the basis of the supplied performance event information with the designated rendition style included therein. In the instant embodiment, the rendition style determination section J4 determines, in accordance with the tone pitch difference limitation condition from the tone pitch difference condition designation section J3, the applicability of the designated rendition style currently set as an object to be imparted to two partially overlapping notes to be sounded in succession. If the tone pitch difference is within a predetermined tone pitch difference condition range (namely, the designated rendition style is applicable), the designated rendition style is determined to be imparted as-is, while, if the tone pitch difference is outside the predetermined tone pitch difference condition range (namely, the designated rendition style is non-applicable), another rendition style is newly determined without the designated rendition style being applied. Then, the rendition style determination section J4 sends the performance event information to a tone synthesis section J6 after having imparted a rendition style designating event ("designated rendition style" in the figure), representing the rendition style to be imparted, to the performance event information. At that time, every designated rendition style other than such a designated rendition style set as an object to be imparted to two partially overlapping notes to be sounded in succession is sent as-is to the tone synthesis section J6.

On the basis of the rendition style received from the rendition style determination section J4, the tone synthesis section 6 reads out, from a rendition style waveform storage section (waveform memory) J5, waveform data for realizing the determined rendition style to thereby synthesize a tone and outputs the thus-synthesized tone. Namely, the tone synthesis section J6 synthesizes a tone of an entire note (or tones of successive notes) by combining, in accordance with the determined rendition style, a head-related (or head-type) rendition style module, body-related (or body-type) rendition style module and tail-related (tail-type) or joint-related (joint-type) rendition style module. Thus, in the case where the tone generator 8 is one having a rendition-style-capable function, such as an AEM tone generator, it is possible to achieve a high-quality rendition style expression by passing the determined rendition style to the tone generator 8. If the tone generator 8 is one having no such rendition-style-capable function, a rendition style expression may of course be realized by appropriately switching between waveforms or passing to the tone generator tone generator control information designating an appropriate envelope shape and other shape, etc.

Next, a description will be given about the tone pitch difference limitation condition. FIGS. 4A and 4B is a conceptual diagram showing examples of the tone pitch difference limitation conditions. As seen from FIG. 4A, each of the tone pitch difference limitation conditions define, for a corresponding designated rendition style, a tone pitch difference (interval) between two notes, as a condition to allow the designated rendition style to be valid or applicable or to permit application of the designated rendition style. According to the illustrated conditions, the tone pitch difference between two notes which permits application of the "gliss joint" rendition style should fall within either a range, i.e., tone pitch difference limitation range, of "+1000 to +1200" cents or a tone pitch difference limitation range of "−1000 to −1200" cents, and the tone pitch difference between two notes which permits application of the "shake joint" rendition style should be within a tone pitch difference limitation range of "−100 to −300" cents. If the designated rendition style falls outside the corresponding tone pitch difference limitation range, any one of default rendition styles preset for application outside the tone pitch difference limitation ranges is applied. Here, there are preset, as the default rendition styles, a "normal joint" rendition style that is a legato rendition style for expressing a performance where two notes of different tone pitches are smoothly interconnected, and a "Joint Head" rendition style that is a "tonguing" rendition style for expressing a performance which sounds like there is a very slight break intervening between two notes, as seen from FIG. 4B. For each of these default rendition styles as well, a tone pitch difference (interval) between two notes is defined as a condition to allow the designated rendition style to be applicable. Note that the tone pitch difference limitation conditions can be set and modified as desired by the user. Further, the tone pitch difference limitation condition for each of the rendition styles may be set to different values for each of human players, types of musical instruments, performance genres, etc.

Figure 5:
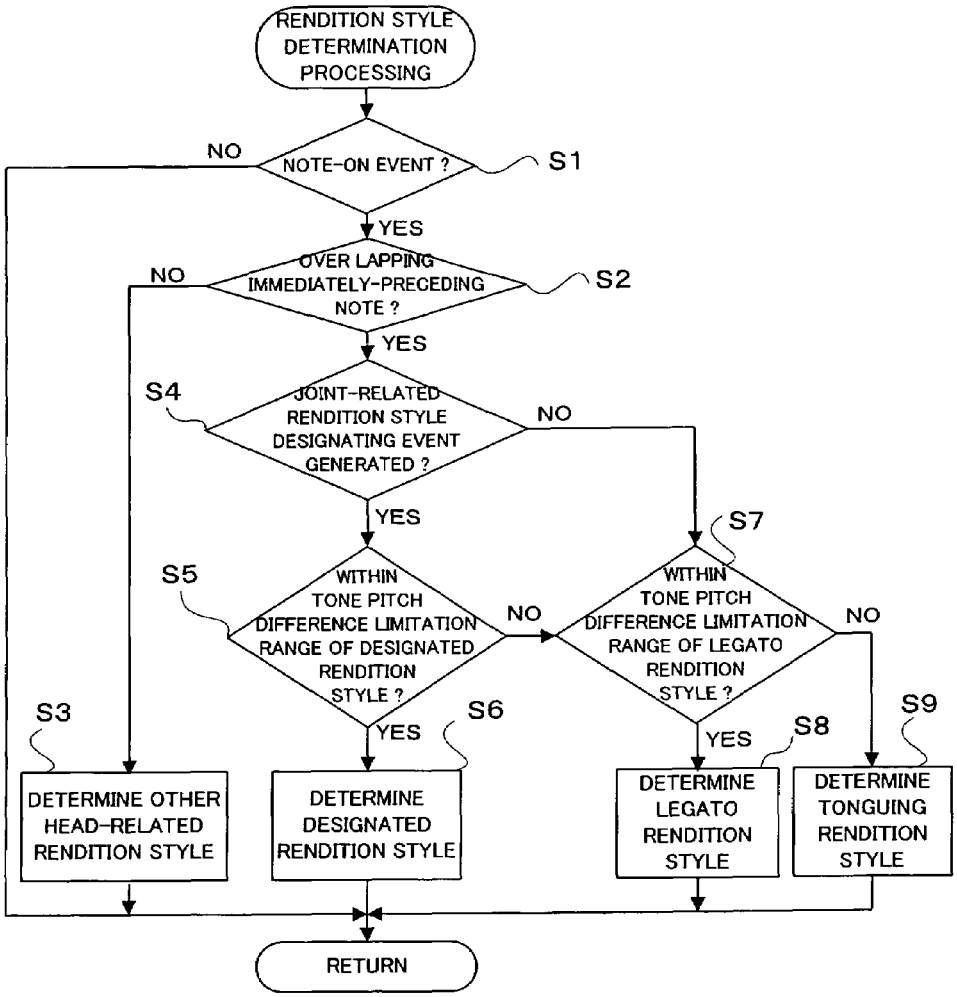
FIG. 5 is a flow chart showing an example operational sequence of rendition style determination processing carried out in the first embodiment.

Now, the "rendition style determination processing" will be described with reference to FIG. 5. FIG. 5 is a flow chart showing an example operational sequence of the "rendition style determination processing" carried out by the CPU 1 in the electronic musical instrument of FIG. 1. First, at step S1, a determination is made as to whether currently-supplied performance event information is indicative of a note-on event. If the performance event information is not indicative of a note-on event (NO determination at step S1), the rendition style determination processing is brought to an end. If, on the other hand, the performance event information is indicative of a note-on event (YES determination at step S1), it is further determined, at step S2, whether a note to be currently sounded or turned on (hereinafter referred to as a "current note") is a note to be sounded in a timewise overlapping relation to an immediately-preceding note that has already been turned on but note yet been turned off. If the current note is not a note to be sounded in a timewise overlapping relation to the immediately-preceding note, i.e. if, before turning-off of the immediately-preceding (i.e., first) note, the current note (i.e., second note) has not yet been turned on (i.e., note-on event signal has not yet been given), (NO determination at step S2), a "head-related rendition type" is determined as a rendition style to be imparted to the current rendition style (step S3), and a pitch of the current note is acquired and stored in memory. If, at that time, a rendition style designating event that designates a head-related rendition style has already been designated, then the designated head-related rendition style is set as a rendition style to be imparted to the current note. If, on the other hand, no rendition style designating event that designates a head-related rendition style has not yet been designated yet, a normal head rendition style is set as a head-related rendition style to be imparted to the current note.

If the current note partially overlaps the immediately-preceding node as determined at step S2 above, i.e. if, before turning-off of the immediately-preceding (i.e., first) note, a note-on event signal has been input for the current note (i.e., second note) (YES determination at step S2), a further determination is made, at step S4, as to whether any joint-related rendition style designating event has already been generated. If answered in the affirmative (YES determination) at step S4, the processing goes to step S5, where a further determination is made, on the basis of the tone pitch difference limitation condition, as to whether the tone pitch difference between the current note and the immediately-preceding note is within the tone pitch difference limitation range of the designated rendition style. With an affirmative (YES) determination at step S5, the designated rendition style is determined to be applicable and ultimately determined as a rendition style to be imparted, at step S6. If no joint-related rendition style designating event has been generated (NO determination at step S4) or if the tone pitch difference between the current note and the immediately-preceding note is not within the tone pitch difference limitation range of the designated rendition style (NO determination at step S5), a further determination is made, at step S7, as to whether the tone pitch difference is within the tone pitch difference limitation range of the preset default legato rendition style. With an affirmative determination at step S7, the default legato rendition style is determined as a rendition style to be imparted at step S8. If, on the other hand, the tone pitch difference is not within the tone pitch difference limitation range of the preset default legato rendition style (NO determination at step S7), the default legato rendition style is determined to be non-applicable, so that a tonguing rendition style is determined as a head-related rendition style to be imparted (step S9).

Figure 6A:
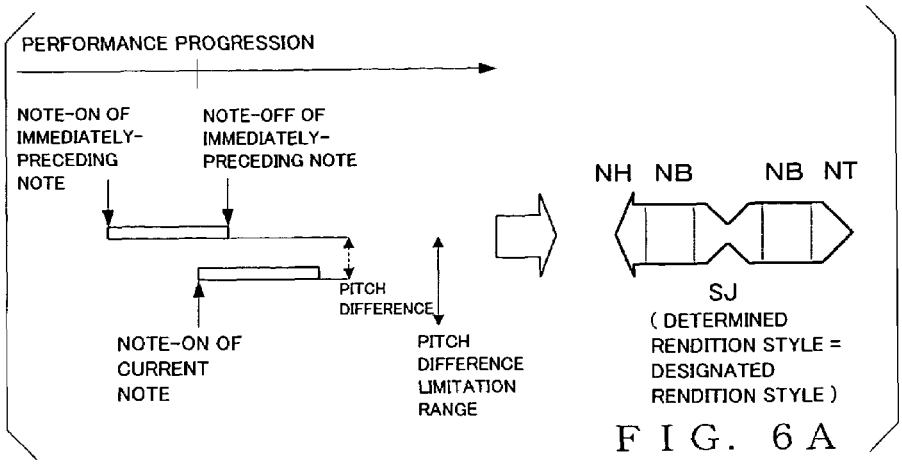
FIGS. 6A-6C are conceptual diagrams of tone waveforms each generated on the basis of a rendition style determined in accordance with a tone pitch difference between a current note and an immediately-preceding note.
Figure 6B:
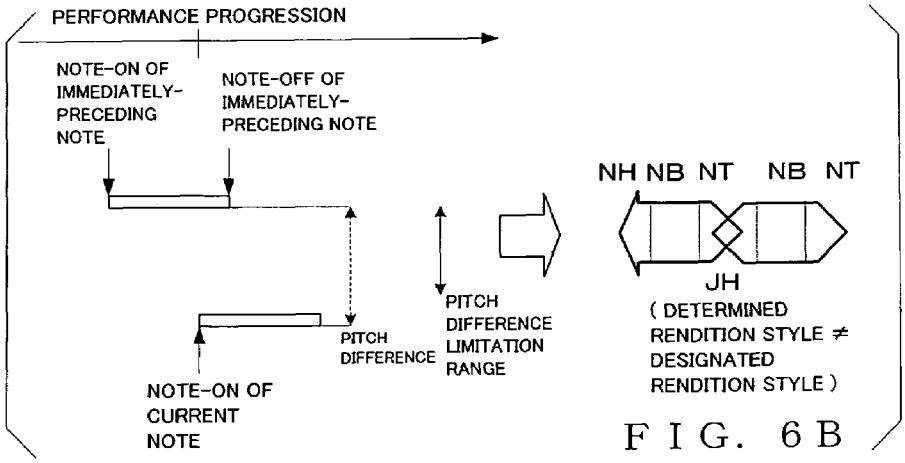
Figure 6C:
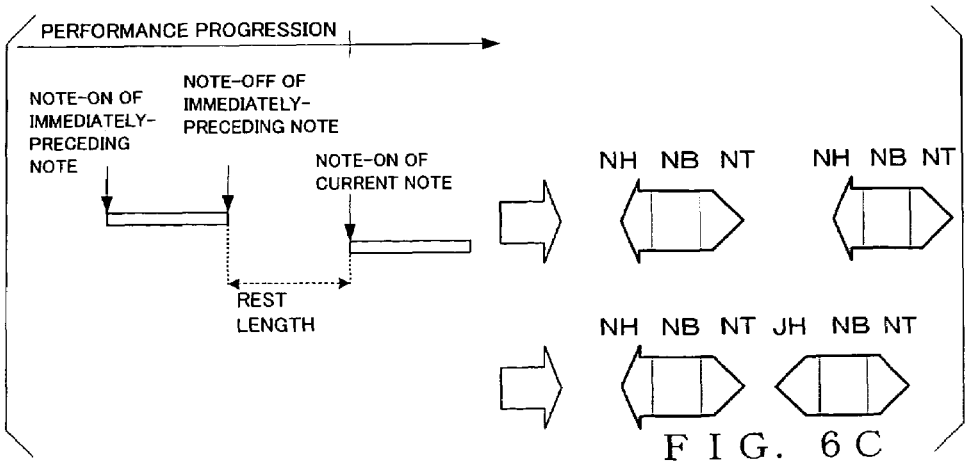

Now, with reference to FIGS. 6A-6C, a description will be made about waveforms ultimately generated on the basis of the rendition style determinations carried out by the above-described "rendition style determination processing" (see FIG. 5). FIGS. 6A-6C are conceptual diagrams of tone waveforms each generated on the basis of a rendition style determined in accordance with a tone pitch difference (interval)

between a current note and an immediately-preceding note. On a left half section of each of these figures, there is shown relationship between the tone pitch difference limitation range and the tone pitch difference between the two notes, while, on a right half section of each of these figures, there is shown an ultimately-generated waveform in an envelope waveform. The following description is made in relation to a case where a Shake Joint (SJ) has been designated as a rendition style to be imparted.

If the tone pitch difference between the current note and the immediately-preceding note is within the tone pitch difference limitation range, then the designated Shake Joint rendition style is determined to be applicable as-is and output as an ultimately-determined rendition style (see step S6 in FIG. 5). Thus, in this case, the immediately-preceding note and current note, each of which is normally expressed as an independent tone waveform comprising a conventional combination of a normal head (NH), normal body (NB) and normal tail (NT), are expressed as a single continuous tone waveform where the normal tail (NT) of the immediately-preceding note and normal head (NH) of the succeeding or current note are replaced with a shake hand (SJ). If, on the other hand, the tone pitch difference between the current note and the immediately-preceding note is not within the tone pitch difference limitation range, a preset default rendition style (in this case, "joint head") is selected as a head-related rendition style of the succeeding current note (see step S9 in FIG. 5). Thus, in this case, the immediately-preceding note is expressed as a waveform of an independent tone comprising a conventional combination of a normal head (NH), normal body (NB) and normal tail (NT) while the succeeding current note is expressed as a waveform of an independent tone representing a tonguing rendition style and comprising a combination of a joint head (JH), normal body (NB) and normal tail (NT), as illustrated in FIG. 6B. As a consequence, the two successive notes are expressed as a waveform where the normal tail (NT) of the immediately-preceding note and the joint head (JH) of the current note overlap with each other. Namely, where two successive notes partially overlap as in the aforementioned case, the current note and immediately-preceding note are expressed as a continuous tone waveform or waveform where parts of the two notes overlap, using a designated rendition style (in this case, "joint head") or default rendition style (in this case, "normal joint head") for the trailing end of the immediately-preceding note and leading end of the succeeding or current note in accordance with the tone pitch difference between the current note and immediately-preceding note.

Where two successive notes do not overlap, on the other hand, another head-related rendition style is determined as a head-related rendition style of the current note (see step S3 in FIG. 5). In this case, the current note is expressed either as a combination of a normal head (NH), normal body (NB) and normal tail (NT) or as a combination of a joint head (JH), normal body (NB) and normal tail (NT), depending on a time length from turning-off of the immediately-preceding note to turning-on of the current note (i.e., rest length from the end of the immediately-preceding note to the beginning of the current note), as shown in FIG. 6C. Namely, the leading end of the current note, which succeeds the immediately-preceding note ending in a Normal Tail, is caused to start with a Normal Head, Joint Head or the like depending on the rest length between the two successive notes.

As set forth above, during a real-time performance or automatic performance in the first embodiment, a tone pitch difference between a current note, for which a rendition style to be imparted has been designated, and an immediately-preceding note is acquired, and the thus-acquired tone pitch difference is compared to the corresponding tone pitch difference limitation range to thereby determine whether the designated rendition style is to be applied or not. Then, the designated rendition style or other suitable rendition style is determined as a rendition style to be imparted, in accordance with the result of the applicability determination. In this manner, the instant embodiment can avoid a rendition style from being undesirably applied in relation to a tone pitch difference that is actually impossible because of the specific construction of the musical instrument or characteristics of the rendition style, and thus, it can avoid an unnatural performance, without changing the nuance of a designated rendition style, by applying a standard rendition style. As a consequence, the instant embodiment permits a performance with an increased reality. Further, because the "rendition style determination processing" is arranged as separate processing from the "automatic rendition style determination processing" etc. directed to designation of a rendition style, the "rendition style determination processing" can also be advantageously applied to the conventionally-known apparatus with a considerable ease.

The first embodiment has been described above as being designed to determine a to-be-imparted rendition style in accordance with the applicability determination based on the tone pitch limitation condition, for both the rendition style designation by the human player via the rendition style designation switches and the automatic rendition style based on characteristics of performance data sequentially supplied in performance progression order. However, the present invention is not so limited, and the above-mentioned applicability determination based on the tone pitch limitation condition may be made for only one of the rendition style designation by the human player and the automatic rendition style designation based on the performance data.

Note that, where all tone pitch differences between successive notes fall within the tone pitch difference limitation ranges, rendition styles to be imparted may be determined in a collective manner.

The following paragraphs describe a second embodiment of the present invention, with reference to FIGS. 1-2B and FIGS. 7-11C.

The second embodiment uses a total of ten types of rendition style modules, namely, the seven types described above in relation to the first embodiment and the following three types;

"Bend Head" (abbreviated BH): This is a head-related rendition style module representative of (and hence applicable to) a rise portion of a tone realizing a bend rendition style (bend-up or bend-down) that is a special rendition style different from a normal attack;

"Gliss Head" (abbreviated GH): This is a head-related rendition style module representative of (and hence applicable to) a rise portion of a tone realizing a glissando rendition style (gliss-up or gliss-down) that is a special rendition style different from a normal attack; and "Fall Head" (abbreviated FT): This is a tail-related rendition style module representative of (and hence applicable to) a fall portion of a tone (to a silent state) realizing a fall rendition style that is a special rendition style different from a normal tail Note that "bend-up" rendition style parameters may include parameters of an absolute tone pitch at the time of the end of the rendition style, initial bend depth value, time length from the start to end of sounding, tone volume immediate after the start of sounding, etc.

Figure 7:
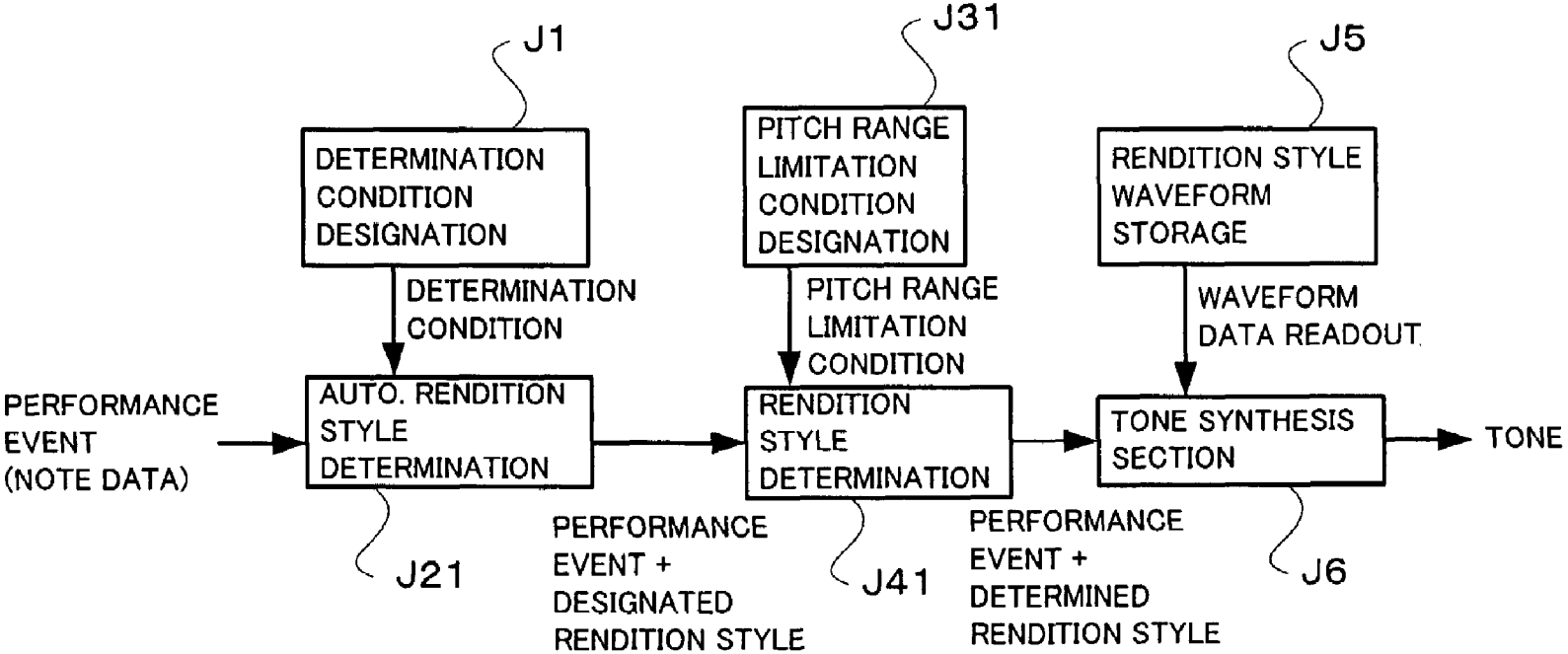
FIG. 7 is a functional block diagram explanatory of an automatic rendition style determination function and ultimate rendition style determination function in a second embodiment of the present invention.

FIG. 7 is a functional block diagram explanatory of the automatic rendition style determination function and ultimate rendition style determination function in the second embodiment of the present invention. Same elements as in FIG. 3 are indicated by the same reference characters and will not be described here to avoid unnecessary duplication.

As in the first embodiment of FIG. 3, an automatic rendition style determination section J21 automatically determines, in accordance with a determination condition given from a determination condition designation section J1, whether a rendition style is to be newly imparted to a note for which no rendition style has been designated. However, in the second embodiment, no special determination as described above in relation to the first embodiment has to be made.

Pitch range limitation condition designation section J31 displays on the display 7 (FIG. 1) a "pitch range limitation condition input screen" (not shown) etc. in response to operation of pitch range limitation condition input switches, and accepts entry of pitch range limitations that are a condition to be used for determining the applicability of a designated rendition style. Rendition style determination section J41 performs "rendition style determination processing" in accordance with a designated or set pitch range limitation condition (see FIG. 9 to be later explained) and ultimately determines a rendition style to be imparted, on the basis of supplied performance event information including the designated rendition style. In the instant embodiment, the rendition style determination section J41 determines, in accordance with the pitch range limitation condition from the pitch range limitation condition designation section J31, the applicability of the designated rendition style as an object to be imparted. If the pitch of the tone to be imparted with the designated rendition style is within a predetermined pitch range limitation range (namely, the designated rendition style is applicable), the designated rendition style is determined as a rendition style to be imparted as-is, while, if the pitch of the note is outside the predetermined pitch range limitation range (namely, the designated rendition style is non-applicable), a preset default rendition style rather than the designated rendition style is determined as a rendition style to be imparted. Then, the rendition style determination section J41 sends the performance event information to a tone synthesis section J6 after having imparted a rendition style designating event, representing the rendition style to be imparted, to the performance event information. At that time, any designated rendition style other than designated rendition styles, for which pitch range limitation ranges have been preset, may be sent as-is to the tone synthesis section J6. Each of the designated rendition styles on which the applicability determination is made is either a rendition style designated by the human player via the rendition style designation switches or a rendition style designated through execution, by the automatic rendition style determination section J21, of "automatic rendition style determination processing".

Here, the "pitch range limitation condition" is explained. FIG. 8 is a conceptual diagram showing some examples of pitch range limitation conditions corresponding to a plurality of designated rendition styles. Each of the pitch range limitation conditions defines, for the corresponding designated rendition style and as a condition for permitting the application of the designated rendition style, a pitch range of a tone to be imparted with the designated rendition style. In the illustrated examples of FIG. 8, the pitch range limitations for permitting the application of each of the "bend head", "gliss head" and "fall tail" rendition styles are that the pitch of the tone, to be imparted with the rendition style, is within the "practical pitch range" and the lowest pitch is 200 cents higher than a lowest-pitched note within the practical pitch range. The pitch range limitations for permitting the application of each of the "gliss joint" and "shake joint" rendition styles are that the pitches of the tones, to be imparted with the rendition style, are both within the "practical pitch range". For example, when a bend(up) head rendition style is to be imparted, a tone pitch at the time of the end of the rendition style is given, as a rendition style parameter, to the bend(up) head rendition style module as noted above; the bend(up) head is a pitch-up rendition style for raising the pitch to a target pitch. Thus, the instant embodiment is arranged to prevent a bend-up from outside the practical pitch range into the practical pitch range, by setting pitch range limitations such that the pitch of the tone to be imparted with the rendition style is limited within the "practical pitch range", and to set the lowest pitch to 200 cents higher than the lowest-pitched note. If any of the designated rendition styles is outside the corresponding pitch range limitation range, a default rendition style preset as a "rendition style to be applied outside the effective pitch range" is applied instead of the designated rendition style. In FIG. 8, any one of "normal head", "normal tail" and "joint head" rendition styles is predefined, as such a default rendition style, for each of the designated rendition styles. It should be obvious that the above-mentioned pitch range limitation condition per rendition style may be set at a different value (or values) for each of human players, types and makers of musical instruments, tone colors to be used, performance genres, etc. The pitch range limitation conditions can be set and modified as desired by the user. Namely, the terms "practical pitch range" as used in the context of the instant embodiment embrace not only a pitch range specific to each musical instrument used but also a desired pitch range made usable by the user (such as a left-hand key range of a keyboard).

Figure 9:
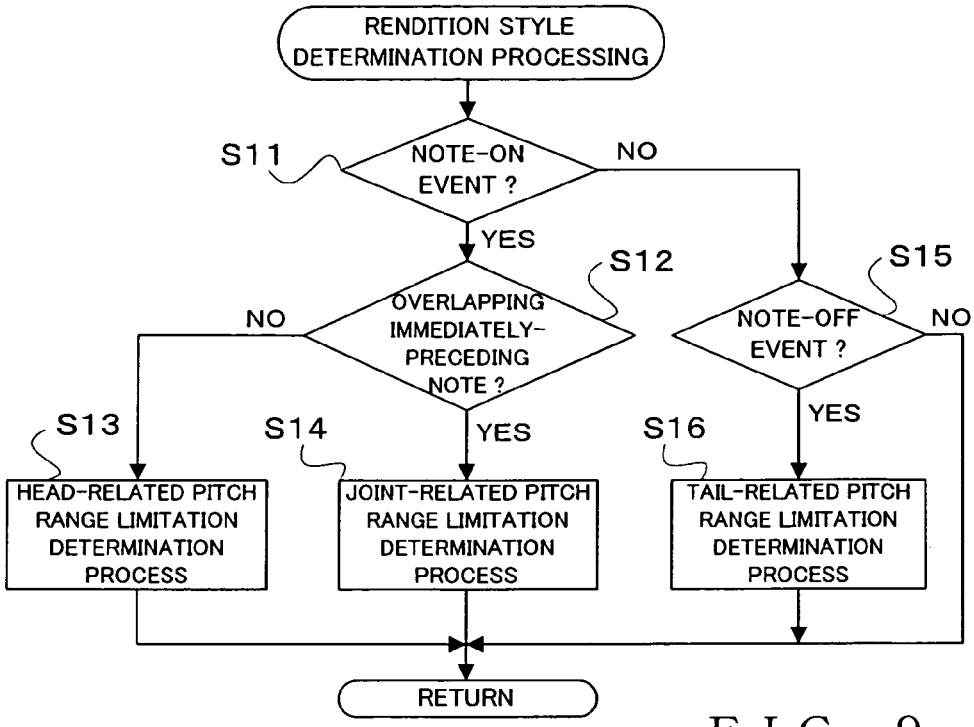
FIG. 9 is a flow chart showing an example operational sequence of rendition style determination processing carried out in the second embodiment.
Figure 10:
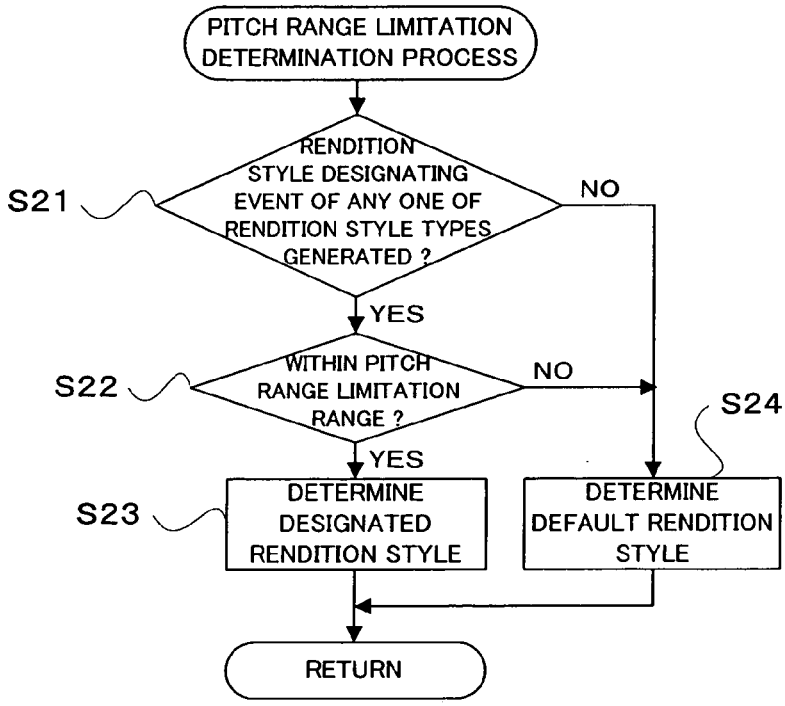
FIG. 10 is a flow chart showing an example operational sequence of each of pitch range limitation determination processes for head-related, joint-related and tail-related rendition styles.

Next, the "rendition style determination processing" will be described below, with reference to FIGS. 9 and 10. FIG. 9 is a flow chart showing an example operational sequence of the "rendition style determination processing" carried out by the CPU 1 in the second embodiment of the electronic musical instrument. First, at step S11, a determination is made as to whether currently-supplied performance event information is indicative of a note-on event, similarly to step S1 of FIG. 5. If the performance event information is indicative of a note-on event, it is further determined, at step S12, whether a note to be currently turned on (hereinafter referred to as a "current note") is a note to be sounded in a timewise overlapping relation to an immediately-preceding note that has already been turned on but not yet been turned off, similarly to step S2 of FIG. 5. If the current note is not a note to be sounded in a timewise overlapping relation to the immediately-preceding note, i.e. if, before turning-off of the immediately-preceding (or first) note, the current (or second) note has not yet been turned on (i.e., note-on event signal has not yet been given), (NO determination at step S12), then a "head-related pitch range limitation determination process" is performed at step S13, to determine a head-related rendition style as a rendition style to be imparted to the current note. If, on the other hand, the current note is a note to be sounded in a timewise overlapping relation to the immediately-preceding note, i.e. if, before turning-off of the immediately-preceding note, the current note has been turned on (i.e., note-on event signal has been given), (YES determination at step S12), then a "joint-related pitch range limitation determination process" is performed at step S14, to determine a joint-related rendition style as a rendition style to be imparted to the current note. If the supplied performance event information is indicative of a note-off event (NO determination at step S11 and then YES determination at step S15), a "tail-related pitch range limitation determination process" is performed at step S16, to determine a tail-related rendition style as a rendition style to be imparted to the current note.

Next, with reference to FIG. 10, a description will be made about the head-related, joint-related and tail-related "pitch range limitation determination processes" carried out at steps S13, S14 and S16, respectively. FIG. 10 is a flow chart showing an example operational sequence of each of the head-related, joint-related and tail-related "pitch range limitation determination processes; to simplify the illustration and explanation, FIG. 10 is a common, representative flow chart of the pitch range limitation determination processes. At step S21, a determination is made as to whether a rendition style designating event of any one of the rendition style types (i.e., head, joint and tail types) has already been generated. If answered in the affirmative (YES determination) at step S21, the process goes to step S22, where a further determination is made, on the basis of the pitch range limitation condition, the current tone (and immediately-preceding tone) is (are) within the pitch range limitation range of the designated rendition style. More specifically, according to the pitch range limitation scheme of FIG. 8, a determination is made, for a head-related or tail-related rendition style, as to whether the tone pitch of the current note is within the practical pitch range, or a determination is made, for a joint-related rendition style, as to whether the tone pitches of the current note and immediately-preceding note are both within the practical pitch range. If the tone (or tones) in question is (are) within the pitch range limitation range of the designated rendition style (YES determination at step S22), the designated rendition style is determined to be applicable and determined as a rendition style to be imparted, at step S23. On the other hand, if no rendition style designating event of the above-mentioned rendition style types has been generated (NO determination at step S21), or if the current tone (and immediately-preceding tone) is (are) not within the pitch range limitation range of the designated rendition style (NO determination at step S22), then a default rendition style is determined as a rendition style to be imparted at step S24. As illustrated in FIG. 8, a normal head, normal tail and joint head are determined as default rendition styles for the designated head-, tail- and joint-related rendition styles, respectively.

Figure 11A:
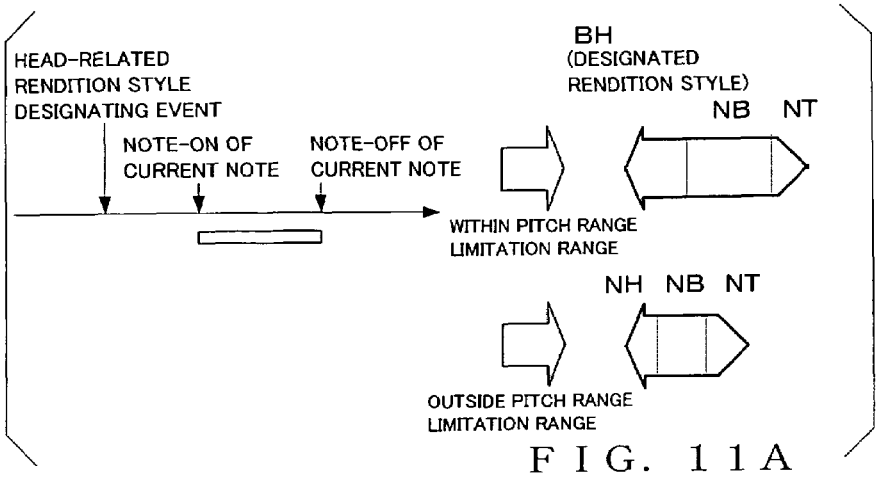
FIGS. 11A-11C are conceptual diagrams of tone waveforms each generated in accordance with whether a pitch of a tone (or pitches of tones) to be imparted with a rendition style is (or are) within a predetermined pitch range limitation range.
Figure 11B:
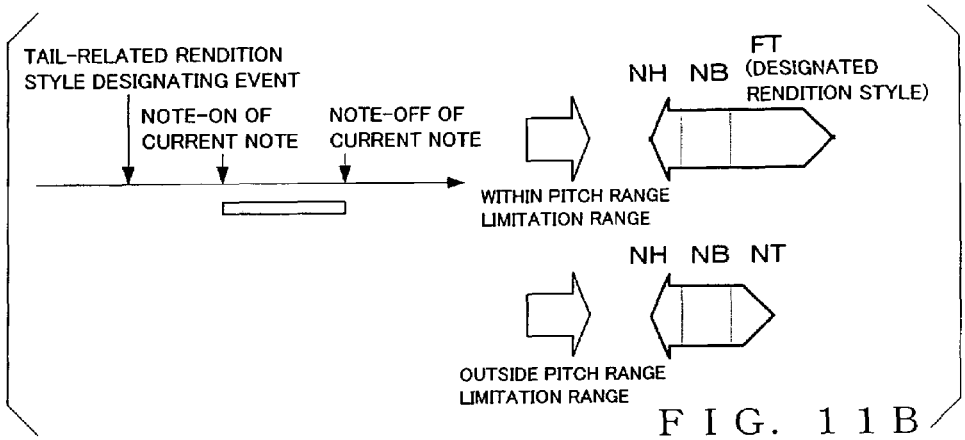
Figure 11C:
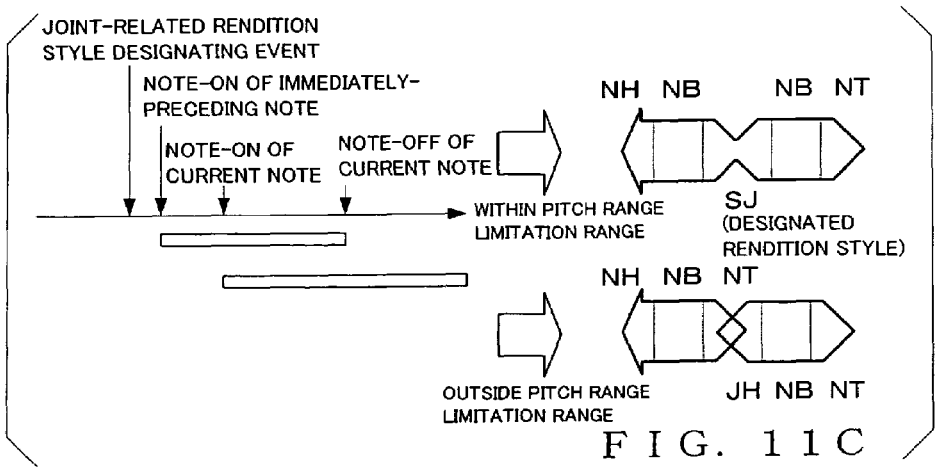

Now, with reference to FIGS. 11A-11C, a description will be made about waveforms ultimately generated on the basis of the rendition style determinations carried out by the above-described "rendition style determination processing" (see FIGS. 9 and 10). FIGS. 11A-11C are conceptual diagrams of tone waveforms each generated on the basis of whether or not the current tone (and immediately-preceding tone) to be imparted with the designated rendition style is (are) within the pitch range limitation range of the designated rendition style. On a left half section of each of these figures, there is shown a tone or tones to be imparted with a rendition style, while, on a right half section of each of these figures, there is shown an ultimately-generated waveform in an envelope waveform. The following description is made in relation to a case where a bend head (BH), fall-tail (FT) and shake joint (SJ) have been designated separately as head-, tail- and joint-related rendition styles.

When the head-related rendition style has been designated and if the tone pitch of the current note, to be imparted with the designated rendition style, is within the pitch range limitation range, the designated bend head (BH) rendition style is determined to be applicable as-is and output as a determined rendition style. Thus, in this case, the current note is expressed as an independent tone waveform comprising a combination of the bend head (BH), normal body (NB) and normal tail (NT), as illustrated in an upper section of FIG. 11A. If, on the other hand, the tone pitch of the current note, to be imparted with the designated rendition style, is not within the pitch range limitation range, the designated bend head (BH) rendition style is determined to be non-applicable, so that a default rendition style is output as a determined rendition style. Thus, in this case, the current note is expressed as an independent tone waveform comprising a combination of a normal head (NH), normal body (NB) and normal tail (NT), as illustrated in a lower section of FIG. 11A.

When the tail-related rendition style has been designated and if the tone pitch of the current note, to be imparted with the designated rendition style, is within the pitch range limitation range, the designated fall tail head (FT) rendition style is determined to be applicable as-is and output as a determined rendition style. Thus, in this case, the current note is expressed as an independent tone waveform comprising a combination of a normal head (NH), normal body (NB) and fall tail (FT), as illustrated in an upper section of FIG. 11B. If the tone pitch of the current note, to be imparted with the designated rendition style, is not within the pitch range limitation range, the designated fall tail (FT) rendition style is determined to be non-applicable, so that a default rendition style is output as a determined rendition style. Thus, in this case, the current note is expressed as an independent tone waveform comprising a combination of a normal head (NH), normal body (NB) and normal tail (NT), as illustrated in a lower section of FIG. 11B.

When the joint-related rendition style has been designated and if the tone pitches of the current note and immediately-preceding note, to be imparted with the designated rendition style, are both within the pitch range limitation range, the designated shake joint (SJ) rendition style is determined to be applicable as-is and output as a determined rendition style. Thus, in this case, the immediately-preceding note and current note, each of which normally comprises a combination of a normal head (NH), normal body (NB) and normal tail (NT), are expressed as an independent tone waveform with the normal tail of the immediately-preceding note and normal head of the succeeding or current note replaced with the shake joint (SJ) rendition style module. If the tone pitches of the current note and immediately-preceding note are not both within the pitch range limitation range, the designated fall tail (FT) rendition style is determined to be non-applicable, so that a default rendition style is output as a determined rendition style. Thus, in this case, the immediately-preceding note is expressed as an independent tone waveform comprising a conventional combination of a normal head (NH), normal body (NB) and normal tail (NT) while the succeeding or current note is expressed as an independent tone waveform comprising a combination of a joint head (NH), normal body (NB) and normal tail (NT) as illustrated in a lower section of FIG. 11C. Namely, the immediately-preceding note and current note are expressed in a waveform where the normal tail (NT) of the immediately-preceding note and the joint head (NH) of the current note overlap each other.

As set forth above, during a real-time performance or automatic performance in the second embodiment, a tone pitch of the current note (and tone pitch of the note immediately preceding the current note), for which a rendition style to be imparted has already been designated, is (are) acquired, and the thus-acquired tone pitch (or tone pitches) is (are) compared to the corresponding pitch range limitation range to thereby determine whether the designated rendition style is to be applied or not. Then, the designated rendition style or other suitable rendition style is determined as a rendition style to be imparted, in accordance with the result of the applicability determination. In this manner, the second embodiment can avoid a rendition style, which uses a tone pitch outside the practical pitch range and hence non-realizable with a natural musical instrument, from being undesirably applied as-is, and thus, it can avoid an unnatural performance, without changing the nuance of a designated rendition style, by applying a standard reference style instead of the rendition style using the tone pitch outside the practical pitch range. As a result, the instant embodiment permits a performance with an increased reality. Further, because the "rendition style determination processing" is arranged as separate processing from the "automatic rendition style determination processing" etc. directed to designation of a rendition style, the "rendition style determination processing" can also be advantageously applied to the conventionally-known apparatus with a considerable ease.

The above-described rendition style applicability determination based on the pitch range limitations may also be carried out in accordance with pitch range limitations in a case a body-related rendition style has been designated, without being restricted to the cases where any of head-, tail- and joint-related rendition styles has been designated.

The second embodiment has been described above as designed to determine a to-be-imparted rendition style in accordance with the applicability determination based on the pitch range limitations, for both the rendition style designation by the human player via the rendition style designation switches and the automatic rendition style designation based on characteristics of performance data sequentially supplied in performance progression order. However, the present invention is not so limited, and the above-mentioned applicability determination based on the pitch range limitations may be carried out for only one of the rendition style designation by the human player and the automatic rendition style designation based on the performance data.

Further, whereas each of the embodiments has been described above in relation to a monophonic mode where a software tone generator sounds a single note at a time, it may be applied to a polyphonic mode where a software tone generator sounds a plurality of single notes at a time. Furthermore, performance data constructed in the polyphonic mode may be broken down to a plurality of monophonic sequences, and these monophonic sequences may be processed by a plurality of rendition style determination functions. In this case, it will be convenient if the results of the performance data breakdown are displayed on the display 7 so that the user can ascertain and modify the breakdown results.

It should also be appreciated that the waveform data employed in the present invention may be other than those constructed using rendition style modules as described above, such as waveform data sampled using the PCM, DPCM, ADPCM or other scheme. Namely, the tone generator 8 may employ any of the known tone signal generation techniques such as: the memory readout method where tone waveform sample value data stored in a waveform memory are sequentially read out in accordance with address data varying in response to the pitch of a tone to be generated; the FM method where tone waveform sample value data are acquired by performing predetermined frequency modulation operations using the above-mentioned address data as phase angle parameter data; and the AM method where tone waveform sample value data are acquired by performing predetermined amplitude modulation operations using the above-mentioned address data as phase angle parameter data. Other than the above-mentioned, the tone generator 8 may use the physical model method, harmonics synthesis method, format synthesis method, analog synthesizer method using VCO, VCF and VCA, analog simulation method, or the like. Further, instead of constructing the tone generator 8 using dedicated hardware, tone generator circuitry 8 may be constructed using a combination of the DSP and microprograms or a combination of the CPU and software. Furthermore, a plurality of tone generation channels may be implemented either by using a single circuit on a time-divisional basis or by providing a separate circuit for each of the channels. Therefore, the information designating a rendition style may be other than the rendition style designating event information, such as information arranged in accordance with the above-mentioned tone signal generation technique employed in the tone generator 8.

Furthermore, in the case where the above-described rendition style determination apparatus is applied to an electronic musical instrument, the electronic musical instrument may be of any type other than the keyboard-type instrument, such as a stringed, wind or percussion instrument. In such a case, the present invention is of course applicable not only to such an electronic musical instrument where all of the performance operator unit, display, tone generator, etc. are incorporated together as a unit within the electronic musical instrument, but also to another type of electronic musical instrument where the above-mentioned components are provided separately and interconnected via communication facilities such as a MIDI interface, various networks and the like. Further, the rendition style determination apparatus of the present invention may comprise a combination of a personal computer and application software, in which case various processing programs may be supplied to the rendition style determination apparatus from a storage medium, such as a magnetic disk, optical disk or semiconductor memory, or via a communication network. Furthermore, the rendition style determination apparatus of the present invention may be applied to automatic performance apparatus, such as karaoke apparatus and player pianos, game apparatus, and portable communication terminals, such as portable telephones. Further, in the case where the rendition style determination apparatus of the present invention is applied to a portable communication terminal, part of the functions of the portable communication terminal may be performed by a server computer so that the necessary functions can be performed cooperatively by the portable communication terminal and server computer. Namely, the rendition style determination apparatus of the present invention may be arranged in any desired manner as long as it can use predetermined software or hardware, based on the basic principles of the present invention, to effectively avoid application of a rendition style in relation to a tone pitch difference that is actually impossible because of a specific construction of a musical instrument or characteristics of the rendition style.

What is claimed is:

1. A rendition style determination apparatus comprising:

a supply section that supplies performance event information;

a setting section that sets a separate tone pitch difference limitation range for each of a plurality of rendition styles;

a detection section that, on the basis of the performance event information supplied by said supply section, detects at least two notes to be sounded in succession or in an overlapping relation to each other and detects a tone pitch difference between the detected at least two notes;

an acquisition section that acquires information designating a rendition style to be imparted to the detected at least two notes; and a rendition style determination section that, on the basis of a comparison between the tone pitch difference limitation range set by said setting section and corresponding to the rendition style designated by the information acquired by said acquisition section and the tone pitch difference between the at least two notes detected by said detection section, determines applicability of the rendition style designated by the acquired information, wherein, when said rendition style determination section has determined that the designated rendition style is applicable, said rendition style determination section determines the designated rendition style as a rendition style to be imparted to the detected at least two notes, wherein, when said rendition style determination section has determined that the rendition style designated by the acquired information is non-applicable and that a predetermined default rendition style is applicable, said rendition style determination section determines the default rendition style as the rendition style to be imparted to the detected at least two notes.

2. A rendition style determination apparatus as claimed in claim 1 which further comprises an operation device operable by a human player to designate a desired rendition style, and wherein said acquisition section acquires information designating the desired rendition style that is generated in response to operation of said operation device.

3. A rendition style determination apparatus comprising:

a supply section that supplies performance event information;

a setting section that sets a separate tone pitch difference limitation range for each of a plurality of rendition styles;

a detection section that, on the basis of the performance event information supplied by said supply section, detects at least two notes to be sounded in succession or in an overlapping relation to each other and detects a tone pitch difference between the detected at least two notes;

an acquisition section that acquires information designating a rendition style to be imparted to the detected at least two notes; and a rendition style determination section that, on the basis of a comparison between the tone pitch difference limitation range set by said setting section and corresponding to the rendition style designated by the information acquired by said acquisition section and the tone pitch difference between the at least two notes detected by said detection section, determines applicability of the rendition style designated by the acquired information, wherein, when said rendition style determination section has determined that the designated rendition style is applicable, said rendition style determination section determines the designated rendition as a rendition style to be imparted to the detected at least two notes, wherein said setting section sets, for each of a plurality of types of joint rendition styles for interconnecting at least two notes, the tone pitch difference limitation range such that the joint rendition style is determined to be applicable as long as a tone pitch difference between said at least two notes to be interconnected is within the tone pitch difference limitation range, and wherein said acquisition section acquires information designating any one of the plurality of types of joint rendition styles.

4. A rendition style determination apparatus as claimed in claim 3 wherein the plurality of types of joint rendition styles include at least a gliss joint rendition style and shake joint rendition style.

5. A rendition style determination apparatus as claimed in claim 4 wherein, when said rendition style determination section has determined that the rendition style designated by the acquired information is non-applicable, said rendition style determination section further determines whether any one of predetermined default rendition styles is applicable, to determine an applicable default rendition style as the rendition style to be imparted to the detected at least two notes, the predetermined default rendition styles including a legato rendition style.

6. A rendition style determination method comprising:

a step of supplying performance event information;

a step of supplying, for each of a plurality of rendition styles, a condition for indicating a tone pitch difference limitation range set for the rendition style;

a detection step of, on the basis of the performance event information supplied by said step of supplying, detecting at least two notes to be sounded in succession or in an overlapping relation to each other and detecting a tone pitch difference between the detected at least two notes;

a step of acquiring information designating a rendition style to be imparted to the detected at least two notes; and a determination step of, on the basis of a comparison between the tone pitch difference limitation range set in correspondence with the rendition style designated by the information acquired by said step of acquiring and the tone pitch difference between the at least two notes detected by said detection step, determining applicability of the rendition style designated by the acquired information, wherein, when said determination step has determined that the designated rendition style is applicable, said determination step determines the designated rendition style as a rendition style to be imparted to the detected at least two notes, wherein, when said determination step has determined that the rendition style designated by the acquired information is non-applicable and that a predetermined default rendition style is applicable, said determination step determines the default rendition style as the rendition style to be imparted to the detected at least two notes.

7. A computer-readable medium containing a group of instructions for causing a computer to perform a rendition style determination method, said rendition style determination method comprising:

a step of supplying performance event information;

a step of supplying, for each of a plurality of rendition styles, a condition for indicating a tone pitch difference limitation range set for the rendition style;

a detection step of, on the basis of the performance event information supplied by said step of supplying, detecting at least two notes to be sounded in succession or in an overlapping relation to each other and detecting a tone pitch difference between the detected at least two notes;

a step of acquiring information designating a rendition style to be imparted to the detected at least two notes; and a determination step of, on the basis of a comparison between the tone pitch difference limitation range set in correspondence with the rendition style designated by the information acquired by said step of acquiring and the tone pitch difference between the at least two notes detected by said detection step, determining applicability of the rendition style designated by the acquired information, wherein, when said determination step has determined that the designated rendition style is applicable, said determination step determines the designated rendition style as a rendition style to be imparted to the detected at least two notes, wherein, when said determination step has determined that the rendition style designated by the acquired information is non-applicable and that a predetermined default rendition style is applicable, said determination step determines the default rendition style as the rendition style to be imparted to the detected at least two notes.

8. A rendition style determination apparatus comprising:

a supply section that supplies performance event information;

a setting section that sets a separate pitch range limitation range for each of a plurality of rendition styles;

an acquisition section that acquires information designating a rendition style to be imparted to a tone;

a detection section that, on the basis of the performance event information supplied by said supply section, detects a tone to be imparted with the rendition style designated by the information acquired by said acquisition section and a pitch of the tone; and a rendition style determination section that, on the basis of a comparison between the pitch range limitation range set by said setting section and corresponding to the rendition style designated by the information acquired by said acquisition section and the pitch of the tone detected by said detection section, determines applicability of the rendition style designated by the acquired information, wherein, when said rendition style determination section has determined that the designated rendition style is applicable, said rendition style determination section determines the designated rendition style as a rendition style to be imparted to the detected tone, wherein, when said rendition style determination section has determined that the rendition style designated by the acquired information is non-applicable, said rendition style determination section determines a predetermined default rendition style as the rendition style to be imparted to the detected tone.

9. A rendition style determination apparatus as claimed in claim 8 which further comprises an operation device operable by a human player to designate a desired rendition style, and wherein said acquisition section acquires information designating the desired rendition style that is generated in response to operation of said operation device.

10. A rendition style determination apparatus as claimed in claim 8, wherein said setting section sets, for each of a plurality of types of rendition styles for interconnecting at least two notes, the pitch range limitation range such that the rendition style is determined to be applicable as long as a tone pitch difference between said at least two notes to be interconnected is within the tone pitch difference limitation range, and wherein said acquisition section acquires information designating any one of the plurality of types of rendition styles.

11. A rendition style determination apparatus as claimed in claim 10 wherein the plurality of types of rendition styles include at least any one of a rendition style to be imparted when generation of a tone starts, a rendition style to be imparted when generation of a tone ends and a rendition style when a plurality of tones are to be connected together.

12. A rendition style determination apparatus as claimed in claim 11 wherein, said predetermined default rendition styles is a rendition style similar in type to the rendition style designated by the acquired information.

13. A rendition style determination method comprising:

a step of supplying performance event information;

a step of supplying a condition for indicating a separate pitch range limitation range set for each of a plurality of rendition styles;

a step of acquiring information designating a rendition style to be imparted to a tone;

a detection step of, on the basis of the performance event information supplied by said step of supplying, detecting a tone to be imparted with the rendition style designated by the information acquired by said step of acquiring and a pitch of the tone; and a determination step of, on the basis of a comparison between the pitch range limitation range set in correspondence with the rendition style designated by the acquired information and the pitch of the tone detected by said detection step, determining applicability of the rendition style designated by the acquired information, wherein, when said determination step has determined that the designated rendition style is applicable, said determination determines the designated rendition style as a rendition style to be imparted to the detected tone, wherein, when said rendition style determination section has determined that the rendition style designated by the acquired information is non-applicable, said rendition style determination section determines a predetermined default rendition style as the rendition style to be imparted to the detected tone.

14. A computer-readable medium containing a group of instructions for causing a computer to perform a rendition style determination method, said rendition style determination method comprising:

a step of supplying performance event information;

a step of supplying a condition for indicating a separate pitch range limitation range set for each of a plurality of rendition styles;

a step of acquiring information designating a rendition style to be imparted to a tone;

a detection step of, on the basis of the performance event information supplied by said step of supplying, detecting a tone to be imparted with the rendition style designated by the information acquired by said step of acquiring and a pitch of the tone; and a determination step of, on the basis of a comparison between the pitch range limitation range set in correspondence with the rendition style designated by the acquired information and the pitch of the tone detected by said detection step, determining applicability of the rendition style designated by the acquired information, wherein, when said determination step has determined that the designated rendition style is applicable, said determination determines the designated rendition style as a rendition style to be imparted to the detected tone, wherein, when said rendition style determination section has determined that the rendition style designated by the acquired information is non-applicable, said rendition style determination section determines a predetermined default rendition style as the rendition style to be imparted to the detected tone.

15. A rendition style determination apparatus comprising:

a supply section that supplies performance event information;

a setting section that sets a separate tone pitch difference limitation range for each of a plurality of rendition styles;

a detection section that, on the basis of the performance event information supplied by said supply section, detects at least two notes to be sounded in succession or in an overlapping relation to each other and detects a tone pitch difference between the detected at least two notes;

an acquisition section that acquires information designating a rendition style to be imparted to the detected at least two notes; and a rendition style determination section that, on the basis of a comparison between the tone pitch difference limitation range set by said setting section and corresponding to the rendition style designated by the information acquired by said acquisition section and the tone pitch difference between the at least two notes detected by said detection section, determines applicability of the rendition style designated by the acquired information, wherein, when said rendition style determination section has determined that the designated rendition style is applicable, said rendition style determination section determines the designated rendition style as a rendition style to be imparted to the detected at least two notes, wherein, when said rendition style determination section has determined that the rendition style designated by the acquired information is non-applicable, said rendition style determination section determines a predetermined default rendition style as the rendition style to be imparted to the detected at least two notes.

16. A rendition style determination method comprising:

a step of supplying performance event information;

a step of supplying, for each of a plurality of rendition styles, a condition for indicating a separate tone pitch difference limitation range set for the rendition style;

a detection step of, on the basis of the performance event information supplied by said step of supplying, detecting at least two notes to be sounded in succession or in an overlapping relation to each other and detecting a tone pitch difference between the detected at least two notes;

a step of acquiring information designating a rendition style to be imparted to the detected at least two notes; and a determination step of, on the basis of a comparison between the tone pitch difference limitation range set in correspondence with the rendition style designated by the information acquired by said step of acquiring and the tone pitch difference between the at least two notes detected by said detection step, determining applicability of the rendition style designated by the acquired information, wherein, when said determination step has determined that the designated rendition style is applicable, said determination step determines the designated rendition style as a rendition style to be imparted to the detected at least two notes, wherein, when said determination step has determined that the rendition style designated by the acquired information is non-applicable, said determination step determines a predetermined default rendition style as the rendition style to be imparted to the detected at least two notes.

17. A computer-readable medium containing a group of instructions for causing a computer to perform a rendition style determination method, said rendition style determination method comprising:

a step of supplying performance event information;

a step of supplying, for each of a plurality of rendition styles, a condition for indicating a separate tone pitch difference limitation range set for the rendition style;

a detection step of, on the basis of the performance event information supplied by said step of supplying, detecting at least two notes to be sounded in succession or in an overlapping relation to each other and detecting a tone pitch difference between the detected at least two notes;

a step of acquiring information designating a rendition style to be imparted to the detected at least two notes; and a determination step of, on the basis of a comparison between the tone pitch difference limitation range set in correspondence with the rendition style designated by the information acquired by said step of acquiring and the tone pitch difference between the at least two notes detected by said detection step, determining applicability of the rendition style designated by the acquired information, wherein, when said determination step has determined that the designated rendition style is applicable, said determination step determines the designated rendition style as a rendition style to be imparted to the detected at least two notes, wherein, when said determination step has determined that the rendition style designated by the acquired information is non-applicable and that a predetermined default rendition style is applicable, said determination step determines a predetermined default rendition style as the rendition style to be imparted to the detected at least two notes.

* * * * *